US010458254B2

(12) United States Patent
Raghavan et al.

(10) Patent No.: US 10,458,254 B2
(45) Date of Patent: Oct. 29, 2019

(54) ABRADABLE COATING COMPOSITION FOR COMPRESSOR BLADE AND METHODS FOR FORMING THE SAME

(71) Applicant: General Electric Company, Schenectady, NY (US)

(72) Inventors: Sathyanarayanan Raghavan, Ballston Lake, NY (US); Neelesh Nandkumar Sarawate, Niskayuna, NY (US); Kenneth Martin Lewis, Liberty Township, OH (US); Larry Steven Rosenzweig, Clifton Park, NY (US); Changjie Sun, Clifton Park, NY (US); Ananda Barua, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 348 days.

(21) Appl. No.: 15/353,101

(22) Filed: Nov. 16, 2016

(65) Prior Publication Data

US 2018/0135646 A1 May 17, 2018

(51) Int. Cl.

| | |
|---|---|
| ***F01D 5/28*** | (2006.01) |
| ***C23C 4/04*** | (2006.01) |
| ***F04D 29/38*** | (2006.01) |
| ***F01D 11/08*** | (2006.01) |

(Continued)

(52) U.S. Cl.

CPC ..... *F01D 5/286* (2013.01); *C23C 4/04* (2013.01); *C23C 4/12* (2013.01); *F01D 5/288* (2013.01); *F01D 11/08* (2013.01); *F01D 11/122* (2013.01); *F04D 29/388* (2013.01);

(Continued)

(58) Field of Classification Search

CPC ..... F04D 29/388; F01D 5/286; F01D 5/288; F01D 11/08; F01D 11/122; C23C 4/04; C23C 4/12; F05D 2220/32; F05D 2230/311; F05D 2230/312; F05D 2230/90; F05D 2250/18; F05D 2250/28; F05D 2250/294; F05D 2260/941; F05D 2300/10;

(Continued)

(56) References Cited

U.S. PATENT DOCUMENTS 3,425,665 A 2/1969 Lingwood
5,704,759 A * 1/1998 Draskovich ..... F01D 11/12 415/170.1

(Continued)

FOREIGN PATENT DOCUMENTS

WO 2001044533 A1 6/2001

OTHER PUBLICATIONS

Bounazef et al., "Blade protection and efficiency preservation of a turbine by a sacrificial material coating", Advanced Powder Technology, vol. 18, Issue: 2, pp. 123-133, 2007.

*Primary Examiner* — Igor Kershteyn
(74) *Attorney, Agent, or Firm* — Dority & Manning, P.A.

(57) ABSTRACT

Coating systems for components of a gas turbine engine, such as a compressor blade tip, are provided. The coating system can include an abradable material disposed along the compressor blade tip and may be used with a bare compressor casing. The abradable coating is softer than the compressor casing and can reduce the overall rub ratio thereby increasing the lifetime of the compressor blade and casing. Methods are also provided for applying the coating system onto a compressor blade.

18 Claims, 6 Drawing Sheets

(51) Int. Cl.
*C23C 4/12* (2016.01)
*F01D 11/12* (2006.01)

(52) U.S. Cl.
CPC .... *F05D 2220/32* (2013.01); *F05D 2230/311* (2013.01); *F05D 2230/312* (2013.01)

(58) Field of Classification Search
CPC ..... F05D 2300/21; F05D 2300/5023; F05D 2300/516
See application file for complete search history.

(56) References Cited

U.S. PATENT DOCUMENTS

| | | | | |
|---|---|---|---|---|
| 6,533,285 | B2 * | 3/2003 | Nava | F01D 11/122 277/411 |
| 6,641,907 | B1 * | 11/2003 | Merrill | C04B 38/0038 428/313.9 |
| 7,163,370 | B2 | 1/2007 | Kokusho | |
| 7,473,072 | B2 | 1/2009 | Malak et al. | |
| 8,177,494 | B2 | 5/2012 | Ward et al. | |
| 8,939,706 | B1 * | 1/2015 | Lee | F01D 11/122 415/1 |
| 2005/0172889 | A1 | 8/2005 | Bellmann et al. | |
| 2013/0045091 | A1 * | 2/2013 | Della-Fera | F01D 11/122 415/174.4 |
| 2014/0064964 | A1 * | 3/2014 | Care | F01D 5/20 416/2 |
| 2015/0240651 | A1 * | 8/2015 | Tham | F01D 11/122 415/1 |
| 2015/0322809 | A1 | 11/2015 | Strock et al. | |
| 2016/0265367 | A1 * | 9/2016 | Rosenzweig | C04B 41/89 |

* cited by examiner

ABRADABLE COATING COMPOSITION FOR COMPRESSOR BLADE AND METHODS FOR FORMING THE SAME

FIELD

Embodiments of the present invention generally relate to abradable coating systems for metallic components, particularly for use on a compressor blade in a gas turbine engine.

BACKGROUND

Gas turbine engines typically include a compressor for compressing air. The compressor includes a series of stages of blades rotating around a shaft. The compressed air is mixed with a fuel and channeled to a combustor, where the mixture is ignited within a combustion chamber to generate hot combustion gases. The combustion gases are channeled to a turbine. The turbine section of a gas turbine engine contains a rotor shaft and one or more turbine stages, each having a turbine disk (or rotor) mounted or otherwise carried by the shaft and turbine blades mounted to and radially extending from the periphery of the disk. A turbine assembly typically generates rotating shaft power by expanding hot compressed gas produced by the combustion of a fuel. Gas turbine buckets or blades generally have an airfoil shape designed to convert the thermal and kinetic energy of the flow path gases into mechanical rotation of the rotor.

In a compressor, as well as in a turbine, engine performance and efficiency may be enhanced by reducing the space between the tip of the rotating blades and the respective casing to limit the flow of air over or around the top of the blade that would otherwise bypass the blade. For example, a compressor blade may be configured so that its tip fits close to the compressor casing during engine operation. During engine operation, however, blade tips may rub against the casing, thereby increasing the gap and resulting in a loss of efficiency, or in some cases, damaging or destroying the blade set. Blade material may be transferred to the compressor case creating scabs on the casing that extend into the clearance between the blades and casing, further aggravating any rubbing against the blade tip. In addition, the high speeds and high contact forces increase the local temperature at the blade tip such that the metal blade tip may melt or soften. The melting or softening of the blade tip may then lead to additional removal of the blade tip material when rubbed against the compressor case. These interactions result in a reduced lifetime of the compressor components.

Thus, an improved design of a compressor blade and a compressor blade and case assembly is desirable in the art.

BRIEF DESCRIPTION

Aspects and advantages of the invention will be set forth in part in the following description, or may be obvious from the description, or may be learned through practice of the invention.

A coated compressor blade is generally provided, the coated compressor blade comprising a compressor blade having a blade tip with a surface, wherein the compressor blade comprises a base material, and a coating system comprising an abradable material disposed along the blade tip surface. In some embodiments, the abradable material comprises zirconia stabilized with calcia, magnesia, yttria, ceria, rare earth oxides, or combinations thereof; rare earth di- or mono-silicates; alumina-silicates; alumina; or combinations thereof.

In certain embodiments, the coating system has a uniform thickness across the blade tip surface, while in certain embodiments, the blade tip surface has a leading edge, a mid-chord, and a trailing edge and the coating system has a larger thickness along the leading edge than along the trailing edge. In some embodiments, the blade tip surface has a leading edge, a mid-chord, and a trailing edge and the coating system is disposed along the leading edge and not disposed along the trailing edge.

In some embodiments, the compressor blade is configured to be positioned in a compressor case and the coating system has a hardness about 20% to about 90% lower than a base material of the compressor case. In certain embodiments, the compressor blade is configured to be positioned in a compressor case and the coating system has a modulus about 20% to about 90% lower than a base material of the compressor case.

In certain embodiments of the present disclosure, the coating system has a thickness of about 102 microns to about 254 microns, and in some embodiments, the coating system does not include a bond coat. The blade of the coated compressor blade, in some embodiments, has a curved body and, in some embodiments, is configured to be positioned in a turbofan engine.

Aspects of the present disclosure are also directed to a gas turbine engine comprising a compressor comprising a compressor case having an inner surface, wherein the compressor case comprises a base material, and a compressor blade having a blade tip, wherein the compressor blade comprises a base material and a coating system disposed along the blade tip of the compressor blade, wherein the coating system has a hardness less than a hardness of the compressor case base material. In some embodiments, the coating system does not include a bond coat. In some embodiments, the coating system comprises an abradable material, and in some embodiments, the hardness of the coating system is about 20% to about 90% lower than the hardness of the compressor case base material.

Aspects of the present disclosure are also directed to a method of preparing a coated compressor blade, the method comprising forming a coating system comprising an abradable material along a surface of a blade tip of a compressor blade. In some embodiments, the step of forming the coating system along the surface of the blade tip comprises forming the abradable material along a leading edge of the blade tip to a thickness of about 102 microns to about 254 microns. In some embodiments, the step of forming the coating system along the surface of the blade tip comprises forming the abradable material along a leading edge of the blade tip to a thickness of about 127 microns to about 254 microns and not disposing abradable material along a trailing edge of the blade tip.

In certain embodiments, the compressor blade is configured to be positioned in a compressor case and the coating system has a hardness about 20% to about 90% lower than a base material of the compressor case. In some embodiments, the compressor blade is configured to be positioned in a compressor case and the coating system has a modulus about 20% to about 90% lower than a base material of the compressor case.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended FIGS., in which.

Figure 1A:
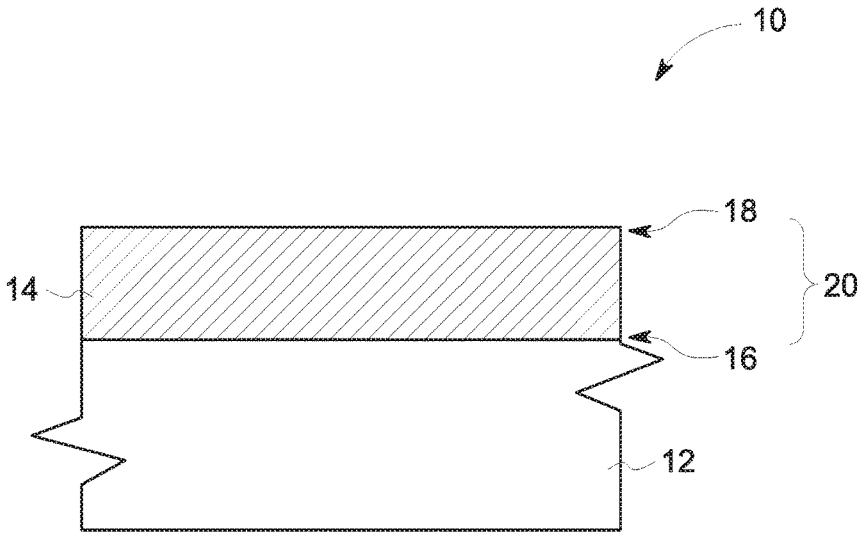
FIGS. 1*a* and 1*b* are schematic views of an exemplary compressor blade comprising a coating system in accordance with one embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "upstream" and "downstream" refer to the relative direction with respect to fluid flow in a fluid pathway. For example, "upstream" refers to the direction from which the fluid flows, and "downstream" refers to the direction to which the fluid flows.

In the present disclosure, when a layer is being described as "on" or "over" another layer or substrate, it is to be understood that the layers can either be directly contacting each other or have another layer or feature between the layers, unless expressly stated to the contrary. Thus, these terms are simply describing the relative position of the layers to each other and do not necessarily mean "on top of" since the relative position above or below depends upon the orientation of the device to the viewer.

Chemical elements are discussed in the present disclosure using their common chemical abbreviation, such as commonly found on a periodic table of elements. For example, hydrogen is represented by its common chemical abbreviation H; helium is represented by its common chemical abbreviation He; and so forth.

A coating system for a compressor blade, for instance a compressor blade tip, is generally provided herein, along with methods of forming such coating system. The composition of the coating system and the methods of applying the coating system to the compressor blade reduce the wear of blade material during high-speed rubs against a bare compressor casing and may thereby increase the lifetime of the compressor blade. The coating system includes an abradable coating that is softer than the material with which the compressor case is formed.

Without intending to be limited by theory, the difference in hardness of the coating system and the compressor case may reduce the overall amount of material that is rubbed off of the blade. The coating system includes a softer coating on the high pressure compressor rotor blades in a gas turbine engine to reduce blade wear during a rubbing event. The coating system is substantially softer than the blade material at the tip of the blade. The coating system may also be softer than the compressor casing material.

The coating system includes an abradable material with a lower hardness (or Young's Modulus) than that of the compressor blade and casing base materials. The coated blade affects the interaction between the blade and the casing during a rub event. Without intending to be bound by theory, when a coated blade initially rubs against the compressor casing, there may be more wear on the blade due to the softer coating. The softer coating on the blade tip may thereby act as a sacrificial layer which is rubbed off when the blade rubs against the case. However, since the blade loses material readily in the initial rub, less contact forces may be generated. Consequently, the blade may experience less deflection and lower amplitudes of vibration, leading to less radial growth of the blade and lower overall wear in the blade during the whole rub event. The initial thickness of the coating may be such that the entire coating is not lost during the initial rub event, and the bond strength between the blade and the coating system may be strong enough to withstand a rub event to avoid rubbing of a bare blade against a bare casing.

The lower contact forces at the blade tip may also result in lower frictional energy dissipation at the blade tip. Heat generated from frictional energy created with conventional blades rubbing against conventional casings may lead to softening of the blade tip or melting of the blade tip. Such softening or melting of the blade material increases the amount of material removed during subsequent rubbing events. With less frictional dissipation due to the coating system, a smaller temperature increase may be observed in the blade. The coating system may thereby reduce softening or melting of the blade and thus reduce further wear of the blade.

In addition, when removed, the coating system may wear out cleanly, without building any material deposition on the casing. When a bare blade and a bare compressor casing rub against each other, the rubbing creates a scab, or deposition of the blade material on the casing. The scab can act as a cutting tool to remove more material from the blade tip. The presence of the softer coating system can help reduce the blade wear, by reducing scab build up.

With certain blades the amount of material loss at the blade tip is typically equivalent to the incursion or interference depth. Turbine blades typically have a 1:1 rub ratio (the ratio of blade material lost to interference). However, compressor blades, particularly aft compressor blades, can have a high rub ratio due to their design and geometry, such as a curved airfoil. When running at high speeds, the airfoil may be pushed radially up to an almost standing position ("radial growth"), thereby rubbing more against the compressor case. Rub ratios significantly exceeding 1:1 have been previously observed for high pressure compressors. The compressor blades can rub on the casing during certain transients, and upon rub, the blades can lose a substantially higher amount of material than the magnitude of the interference. This high rub ratio leads to high blade wear, thereby opening the clearance between the blade tip to the casing, which results in loss of flow that does useful work. High rub ratios have a significant impact on engine performance and operability. Thus, reducing the rub ratio may improve the compressor performance and operability. The present coating system incorporates an abradable material with a lower hardness than that of the compressor case. The softer coating system may reduce the overall blade loss during a rub event and may result in reduced clearance between the stator and rotor during all engine operating conditions. The coating system may thereby improve the specific fuel consumption (SFC) of the engine, resulting in increased fuel economy.

The coating system can thus reduce damage to the blade tip during a rubbing event between stator and rotor, achieve a tighter clearance between the stator and rotor during engine operations, and reduce high rub ratio occurrences.

The coated compressor blade can be utilized as a component for a gas turbine engine. In particular, the coated compressor blade can be positioned within a gas flow path of a gas turbine engine such that the coating system protects the compressor blade within the gas turbine engine. The coating system may be applicable to blades in a high pressure compressor (HPC), fan, booster, high pressure turbine (HPT), and low pressure turbine (LPT) of both airborne and land-based gas turbine engines.

Figure 1B:
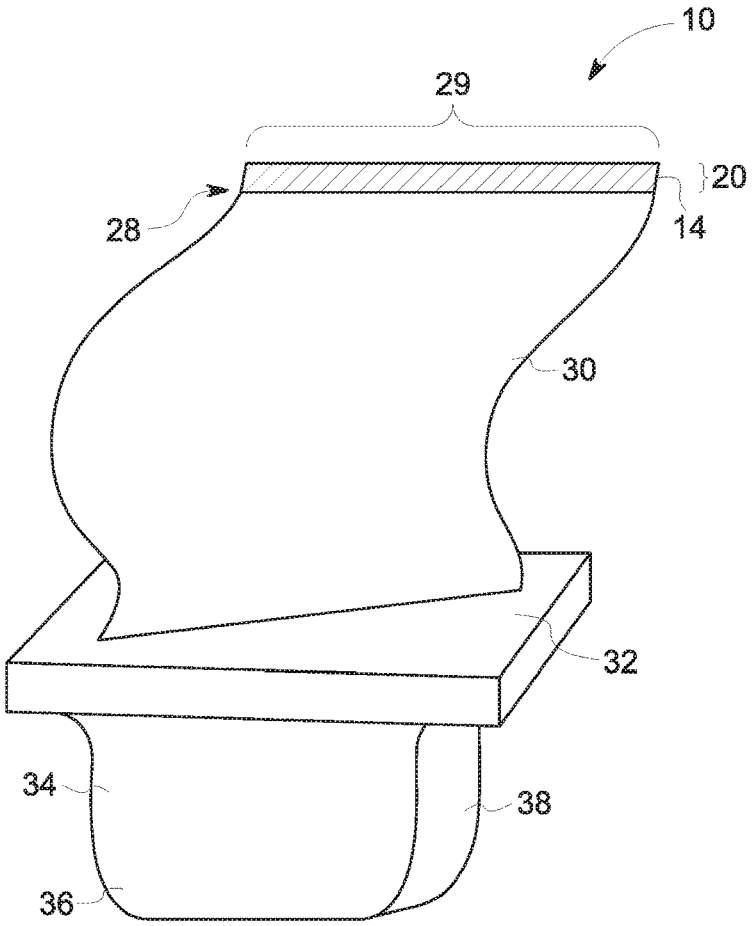

FIGS. 1*a* and 1*b* are schematic views of an exemplary compressor blade comprising a coating system in accordance with one embodiment of the present disclosure. In particular, FIG. 1*a* is a cross-sectional schematic view of a compressor blade 10 comprising a base material 12 and a surface 16. In the embodiment illustrated in FIG. 1*a*, a coating system 20 comprising an abradable material 14 is disposed along the surface 16 of the compressor blade 10. The coating system 20 has a surface 18.

FIG. 1*b* is a schematic of a compressor blade 10 illustrating the various parts of the compressor blade 10. In the embodiment illustrated in FIGS. 1*a* and 1*b*, the blade 10 is generally represented as being adapted for mounting to a disk or rotor within the compressor section of an aircraft gas turbine engine (illustrated e.g. in FIG. 3). For this reason, the blade 10 is represented as including a dovetail 38 for anchoring the blade 10 to a compressor disk by interlocking with a complementary dovetail slot formed in the circumference of the disk. As represented in FIG. 1*b*, the interlocking features comprise protrusions referred to as tangs 36 that engage recesses defined by the dovetail slot. The blade 10 is further shown as having a platform 32 that separates an airfoil 30 from a shank 34 on which the dovetail 38 is defined.

The blade 10 includes a blade tip 28 disposed opposite the platform 32. As such, the blade tip 28 generally defines the radially outermost portion of the blade 10 and, thus, may be configured to be positioned adjacent to a stationary casing (illustrated in FIG. 3) of the compressor. The length of the blade tip 28 may be referred to as the blade chord 29.

As shown in FIG. 1*b*, the airfoil 30 of the compressor blade 10 is a generally curved body in that a portion of the airfoil 30 bends out away from the blade tip 28. The blade tip 28 may be referred to as the interface between the blade and the casing and may be referred to as the rubbing area between the blade and the casing. During use, force applied to the compressor blade 10 may push the generally curved body into a more straightened position (which may be referred to as "radial growth") forcing the blade tip 28 to contact the casing, increasing the occurrence or magnitude of a rub event between the blade tip 28 and the casing.

In certain embodiments, the blade tip 28 comprises a base material 12. In some embodiments, the base material 12 may include a metal such as steel or superalloys (e.g., nickel-based superalloys, cobalt-based superalloys, or iron-based superalloys), or combinations thereof.

As shown in FIG. 1*b*, in this embodiment, the blade tip 28 is coated with a coating system 20. The coating system 20 is disposed along the blade tip 28 in FIG. 1*a*, and may be disposed along the blade tip 28 as well as other portions of the airfoil 30. The coating system 20 may cover at least a portion of the blade tip 28, and in some cases, the coating system 20 may cover the portion of the blade tip 28 most immediately adjacent to the casing when positioned in the compressor section of the engine (see FIG. 3).

The coating system 20 is configured such that rubbing and softening of the blade tip 28 may be reduced. The coating system incorporates components that have a lower hardness than the compressor casing and thereby protect the underlying metal of the base material 12 of the blade tip 28 during rubbing events. For instance, in certain embodiments, the coating system 20 may comprise an abradable material 14 with a lower hardness than the compressor case in which the compressor blade is to be used. Various abradable materials may be suitable in the coating system 20. For instance, the abradable materials may be those with suitable microstructures that provide sufficiently low hardness or modulus. Examples of such materials may include zirconia stabilized with calcia, magnesia, yttria, ceria, or rare earth oxides. Other materials such as rare earth di- or mono-silicates, alumina-silicates, or alumina may also be suitable. Microstructures of deposited materials should have sufficient porosity to have low enough modulus. Columnar type microstructures of ceramic materials result in low modulus coatings with high adhesion to metallic substrates.

The abradable coating may be formed by any suitable process. For instance, one or more abradable materials may be deposited on the compressor blade by suspension plasma spray, solution precursor plasma spray, or combinations thereof. Tip grinding may occur before or after application of the coating system 20.

In some embodiments, the abradable material 14 may be applied to the blade tip 28 to form one or more layers of abradable material 14. In certain embodiments, the abradable material 14 may be applied to the blade tip 28 such that the abradable material 14 becomes dispersed throughout another layer, such as dispersed throughout a matrix of another component along the blade tip 28. In such an embodiment, the abradable material phase can be a discontinuous phase within the matrix or a continuous phase within the matrix. One or more abradable materials 14 may be used along the blade tip 28. For instance, a plurality of abradable materials may be applied to the blade tip 28 and may form one or more abradable materials along the blade tip 28. Various alternative configurations are possible without deviating from the intent of the present disclosure.

The coating system 20 may have a thickness greater than the incursion or expected rub ratio. For instance, in some embodiments, the coating system 20 may have a thickness of about 1 mils (about 25 microns) to about 20 mils (about 508 microns), such as about 2 mils (about 50 microns) to about 15 mils (about 381 microns), about 3 mils (about 76 microns) to about 12 mils (about 305 microns), or about 4 mils (about 102 microns) to about 10 mils (about 254 microns). As shown in FIG. 1*b*, in this embodiment, the coating system 20 is disposed with a uniform thickness along the chord 29 of the blade tip 28. For instance, the coating system 20, in some embodiments, may have a thickness of about 4 mils to about 10 mils along the full chord 29 of the blade tip 28.

Figure 2A:
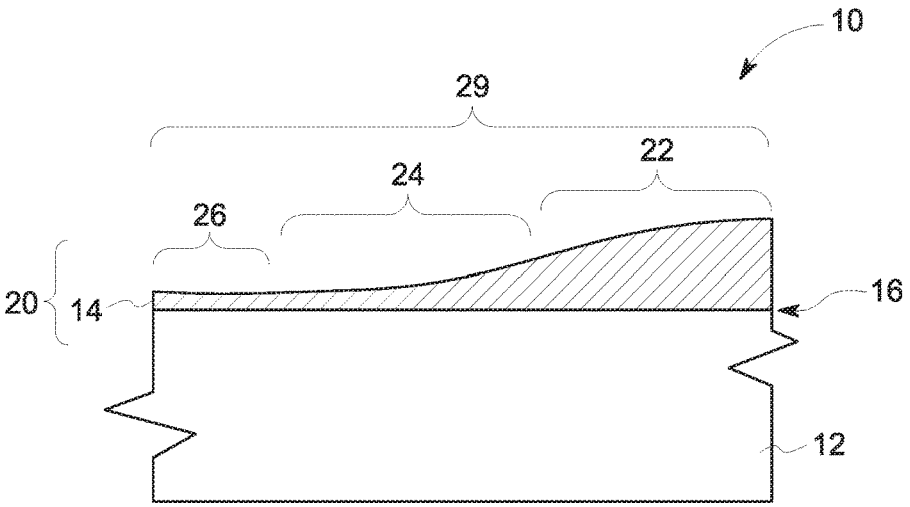
FIGS. 2*a* and 2*b* are schematic views of an exemplary compressor blade comprising a coating system in accordance with one embodiment of the present disclosure.
Figure 2B:
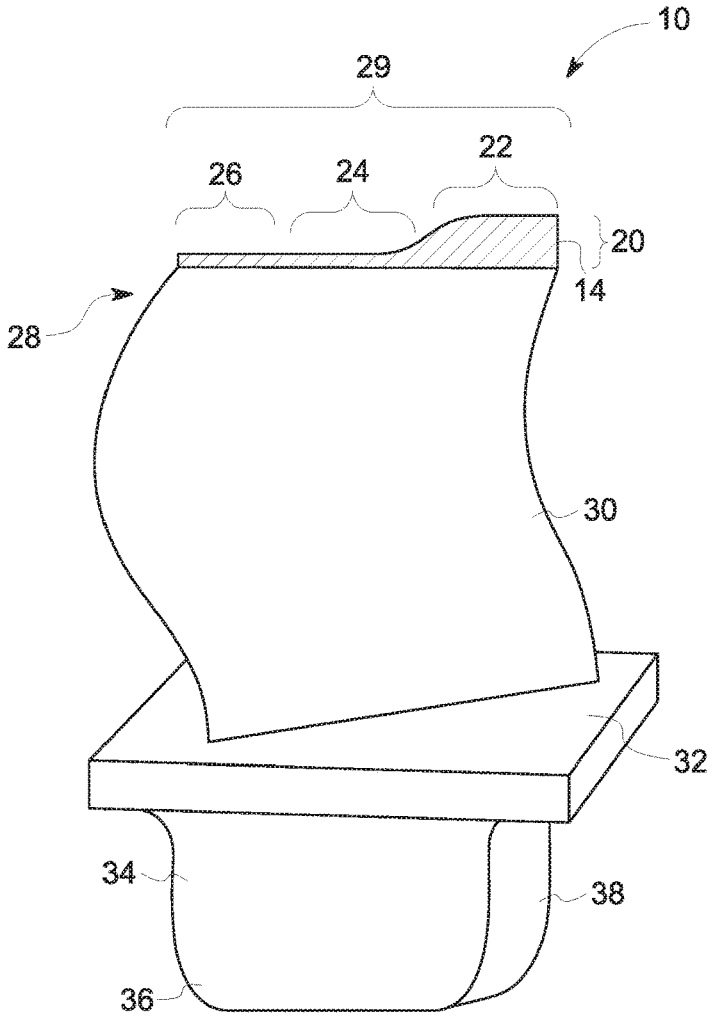

In some embodiments, the coating system 20 may be disposed along certain areas of the blade tip 28 with different thicknesses. FIGS. 2*a* and 2*b* are schematic views of an exemplary compressor blade comprising a coating system in accordance with one embodiment of the present disclosure where the thickness of the coating system 20 varies along the length of the chord 29. In particular, FIG. 2*a* is a cross-sectional schematic view of a compressor blade 10 comprising a base material 12 and a surface 16. In the embodiment illustrated in FIG. 2*a*, a coating system 20 comprising an abradable material 14 is disposed along the surface 16 of the compressor blade 10. The coating system 20 has a surface 18. FIG. 2*b* is a schematic of a compressor blade 10 illustrating the various part and geometry of the compressor blade 10 as noted above.

As shown in FIG. 2*b*, the chord 29 may be divided into sections, such as a leading edge 22, mid-chord 24, and trailing edge 26. The coating system 20 may be disposed along one or more sections of the chord 29, such as only disposed along the leading edge 22, only disposed along the mid-chord 24, or only disposed along the trailing edge 26. In some embodiments, the coating system 20 may be disposed along two or more of these sections of the chord 29 with the same or differing thicknesses. For instance, in the embodiment illustrated in FIG. 2*b*, the coating system 20 is disposed along the leading edge 22 with a greater thickness than the coating system in the mid-chord 24 and the trailing edge 26. The coating system 20 may have a thickness of about 1 mils (about 25 microns) to about 20 mils (about 508 microns), such as about 2 mils (about 50 microns) to about 15 mils (about 381 microns), about 3 mils (about 76 microns) to about 12 mils (about 305 microns), or about 4 mils (about 102 microns) to about 10 mils (about 254 microns) in the leading edge 22, mid-chord 24, and/or trailing edge 26. In some embodiments, the thickness of the coating system 20 may be about 4 mils to about 10 mils in the leading edge 22 while the thickness of the coating system 20 may be less than 4 mils, if present, in the mid-chord 24 and/or the trailing edge 26. In some embodiments, the leading edge 22 may have the highest reduction in rub ratio due to the application of the coating system. Thus, it may be suitable to apply the coating system 20 to the leading edge 22 with a greater thickness than the mid-chord 24 and/or the trailing edge 26. In some embodiments, the trailing edge may be curved more than the leading edge.

Figure 3:
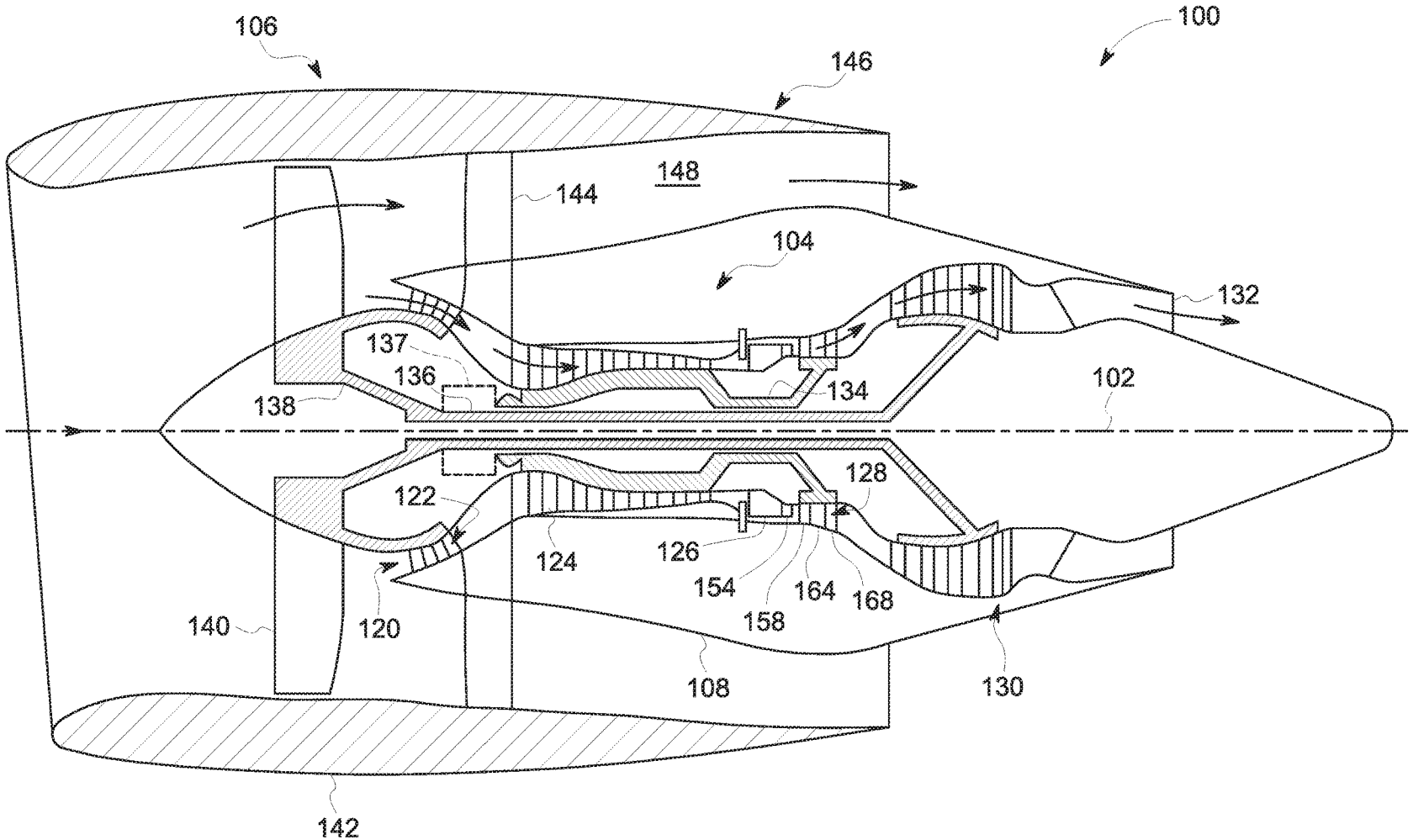
FIG. 3 is a schematic cross-sectional view of an exemplary gas turbine engine in accordance with one embodiment of the present disclosure.

FIG. 3 is a schematic cross-sectional view of a gas turbine engine in accordance with one embodiment of the present disclosure. Although further described below generally with reference to a turbofan engine 100, the present disclosure is also applicable to turbomachinery in general, including turbojet, turboprop and turboshaft gas turbine engines, including industrial and marine gas turbine engines and auxiliary power units.

As shown in FIG. 3, the turbofan 100 has a longitudinal or axial centerline axis 102 that extends therethrough for reference purposes. In general, the turbofan 100 may include a core turbine or gas turbine engine 104 disposed downstream from a fan section 106.

The gas turbine engine 104 may generally include a substantially tubular outer casing 108 that defines an annular inlet 120. The outer casing 108 may be formed from multiple casings. The outer casing 108 encases, in serial flow relationship, a compressor section having a booster or low pressure (LP) compressor 122, a high pressure (HP) compressor 124, a combustion section 126, a turbine section including a high pressure (HP) turbine 128, a low pressure (LP) turbine 130, and a jet exhaust nozzle section 132. A high pressure (HP) shaft or spool 134 drivingly connects the HP turbine 128 to the HP compressor 124. A low pressure (LP) shaft or spool 136 drivingly connects the LP turbine 130 to the LP compressor 122. The LP spool 136 may also be connected to a fan spool or shaft 138 of the fan section 106. In particular embodiments, the LP spool 136 may be connected directly to the fan spool 138 such as in a direct-drive configuration. In alternative configurations, the LP spool 136 may be connected to the fan spool 138 via a speed reduction device 137 such as a reduction gear gearbox in an indirect-drive or geared-drive configuration. Such speed reduction devices may be included between any suitable shafts/spools within engine 100 as desired or required. The HP turbine 128 includes, in serial flow relationship, a first stage of stator vanes 154 (only one shown) axially spaced from turbine rotor blades 158 (only one shown) (also referred to as "turbine blades") and a second stage of stator vanes 164 (only one shown) axially spaced from turbine rotor blades 168 (only one shown) (also referred to as "turbine blades").

As shown in FIG. 3, the fan section 106 includes a plurality of fan blades 140 that are coupled to and that extend radially outwardly from the fan spool 138. An annular fan casing or nacelle 142 circumferentially surrounds the fan section 106 and/or at least a portion of the gas turbine engine 104. It should be appreciated by those of ordinary skill in the art that the nacelle 142 may be configured to be supported relative to the gas turbine engine 104 by a plurality of circumferentially-spaced outlet guide vanes 144. Moreover, a downstream section 146 of the nacelle 142 (downstream of the guide vanes 144) may extend over an outer portion of the gas turbine engine 104 so as to define a bypass airflow passage 148 therebetween.

Figure 4:
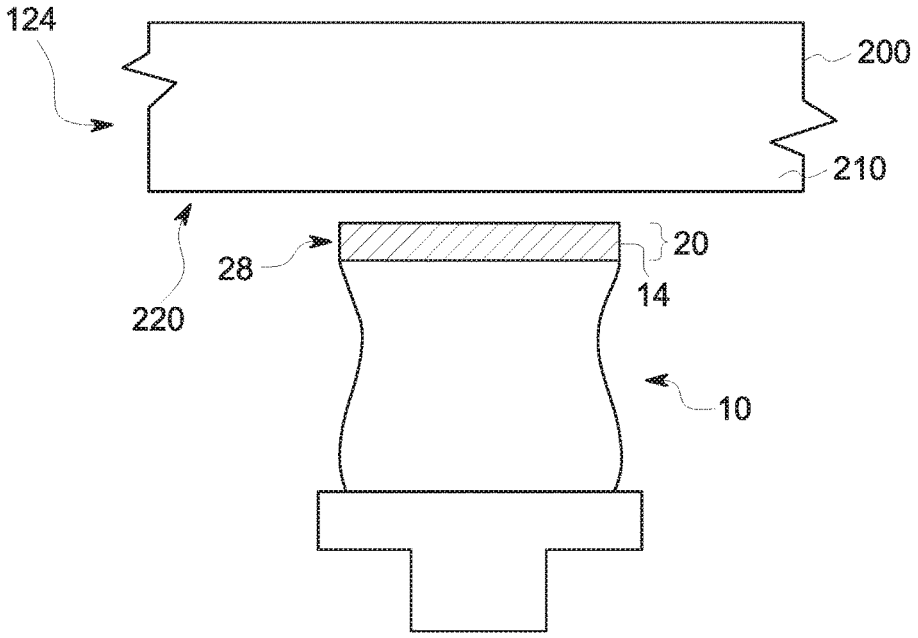
FIG. 4 illustrates an exemplary compressor section in accordance with one embodiment of the present disclosure.

FIG. 4 illustrates an exemplary compressor section in accordance with one embodiment of the present disclosure. In particular, FIG. 4 illustrates a high pressure compressor 124 including a compressor casing 200 with a base material 210 and an inner surface 220. The high pressure compressor 124 also includes a compressor blade 10. In certain embodiments, the base material 210 may include a metal such as steel or superalloys (e.g., nickel-based superalloys, cobalt-based superalloys, or iron-based superalloys), or combinations thereof. As shown in FIG. 4, the compressor case 200 is uncoated. As used herein, "uncoated" or "bare" refers to the absence of a coating or additional layer applied to the base material of the component. For instance, as shown in FIG. 4, the base material 210 of the compressor case 200 extends to the inner surface 220 of the compressor case 200. No abradable coating or additional protective coating is needed for the compressor case 200 in this embodiment.

The high pressure compressor 124 generally operates at lower temperatures than the high pressure turbine 128. For instance, the aft stages of the high pressure compressor 124 may operate at temperatures of 1200-1400° F. (649-760° C.). Accordingly, coatings have not been applied to compressor blades or casings in the past. However, the present coating system provides an improved compressor blade and casing assembly.

In the embodiment illustrated in FIG. 4, the compressor blade 10 includes a coating system 20 comprising an abradable material 14 disposed along the blade tip 28. The coating system 20 has a lower hardness than the base material 210 of the compressor case 200. The coating system 20 may have a hardness at least about 5% lower, such as about 10% to about 95%, or about 20% to about 90% lower than the base material 210 of the compressor case 200. The coating system 20 may have a Young's modulus of about 20,000 ksi or less, such as about 15,000 ksi to about 1000 ksi, about 10,000 ksi to about 2000 ksi, or about 5000 ksi to about 2500 ksi. The coating system 20 may have a Young's modulus of about 5% lower than, such as about 10% to about 95%, about 20% to about 90%, about 40% to about 90% lower than the Young's modulus of the base material 210 of the compressor case 200.

Figure 5:
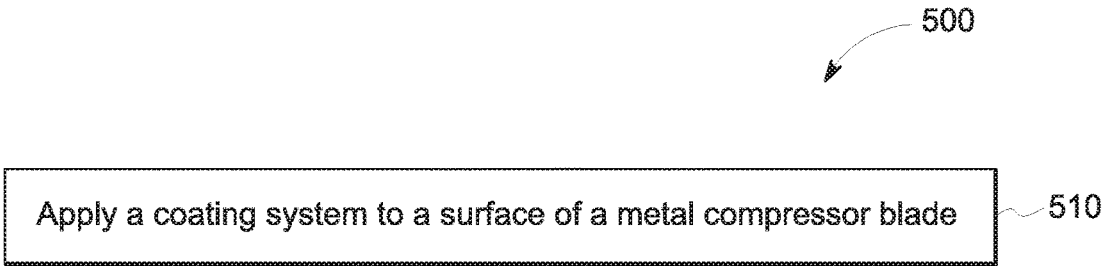
FIG. 5 is an exemplary method of preparing a coating system in accordance with one embodiment of the present disclosure.
Figure 6A:
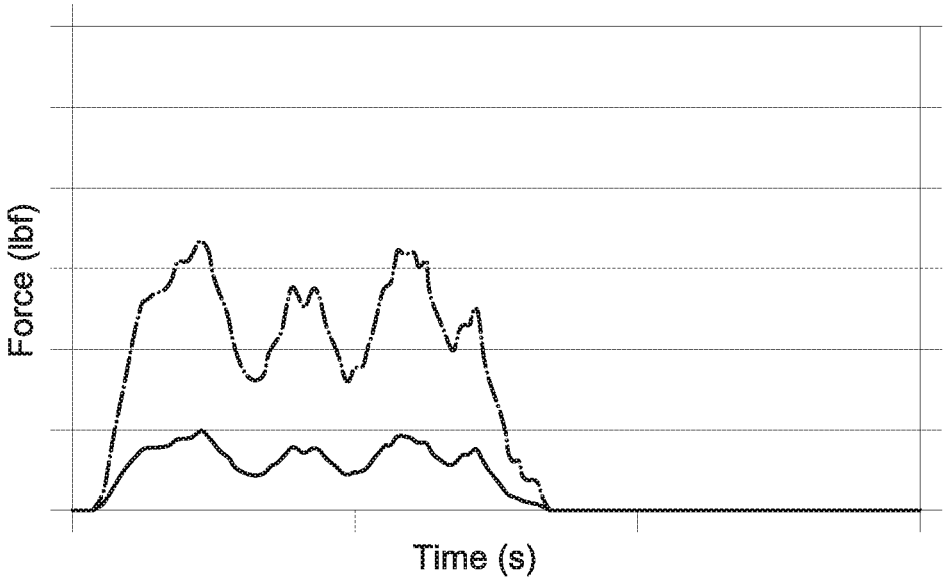
FIGS. 6*a*-6*b* illustrate the effect of a coating system in accordance with one embodiment of the present invention on the contact force on a compressor blade in a compressor.
Figure 6B:
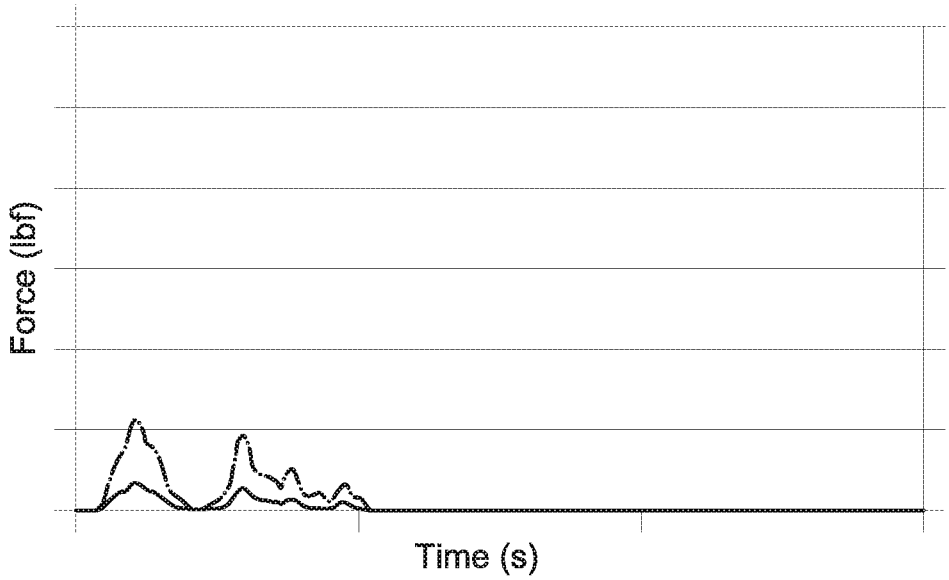

FIG. 5 is a method of preparing a coating system in accordance with one embodiment of the present disclosure. In the embodiment illustrated in FIG. 5, the method of preparing a coated compressor blade 500, particularly a coated compressor blade configured for use with a bare compressor casing, comprises the step of applying a coating system to a surface of a metal compressor blade 510. The coating system comprises an abradable material. For instance, the coating system may be applied to the blade tip of the compressor blade and may be applied specifically to the leading edge, mid-chord, and/or trailing edge of the compressor blade tip. The coating system may be applied by any suitable method as described herein. The method may comprise other treatments to the compressor blade and/or blade tip between each application of coating to further improve blade wear. In some embodiments, a bond coating may be applied to the blade tip to improve adhesion of the abradable material, while in certain embodiments, a bond coat may not be needed. A thin bond coat might be needed to better adhesion to the base metal than the abradable material.

While the present application is discussed in relation to compressor cases, the disclosure may be applied in other applications such as where a coating with a softer material may protect the underlying metal from wear.

EXAMPLES

The coating system was analyzed using transient dynamics analysis. A 3D model of the case and blade was built, and a portion of the casing was offset to apply a specified incursion (or interference depth) between the case and blade. Frictional contact was enabled and material was considered to be eroded based on a failure strain criteria. The model was run for multiple revolutions until there was no further material removal from the blade tip.

Compressor blades were analyzed using the above mentioned modeling methodology for high rub ratio. In this modeling, the rub ratios (ratio of material loss at blade tip to incursion) obtained at the leading edge, mid chord, and trailing edge of the blade tip were higher for the leading edge than the mid chord and trailing edge, for the uncoated blade model. One thing to note is that in the modeling, temperature and scab build-up were not taken into consideration at this stage in the analysis and, thus, the rub ratios in the model were much lower than actually seen in compressors. Temperature and scab build-up generally account for about 50% of the rub ratio. The analysis was repeated with a baseline blade coated with softer material with the same boundary conditions. Results showed that the rub ratio for the coated blade was uniform throughout the blade cord. In this modeling analysis, the softer blade tip coating was able to provide a reduction of about 30% to about 50% in the rub ratio across the whole blade, with a reduction of about 50% at the leading edge. It is noted that after the initial rub, which removes some of the abradable coating, subsequent rubs do not generate much force. With this reduced force against the blade, the blade does not uncurl and, thus, the radial growth seen in conventional blades is not as prevalent.

Figure 7A:
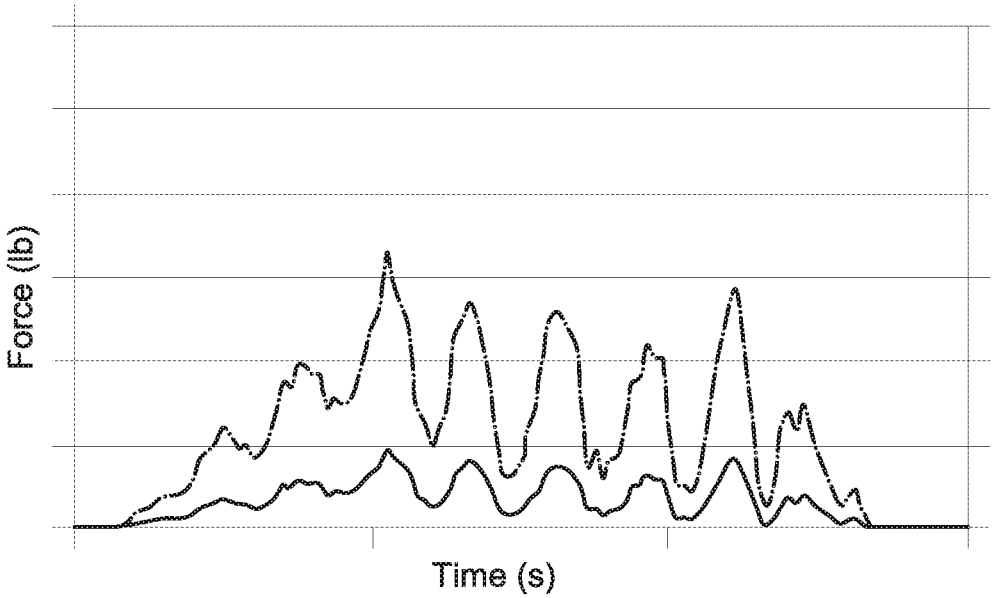
FIGS. 7*a*-7*b* illustrate the effect of a coating system in accordance with one embodiment of the present invention on the contact force on a compressor blade in a compressor.
Figure 7B:
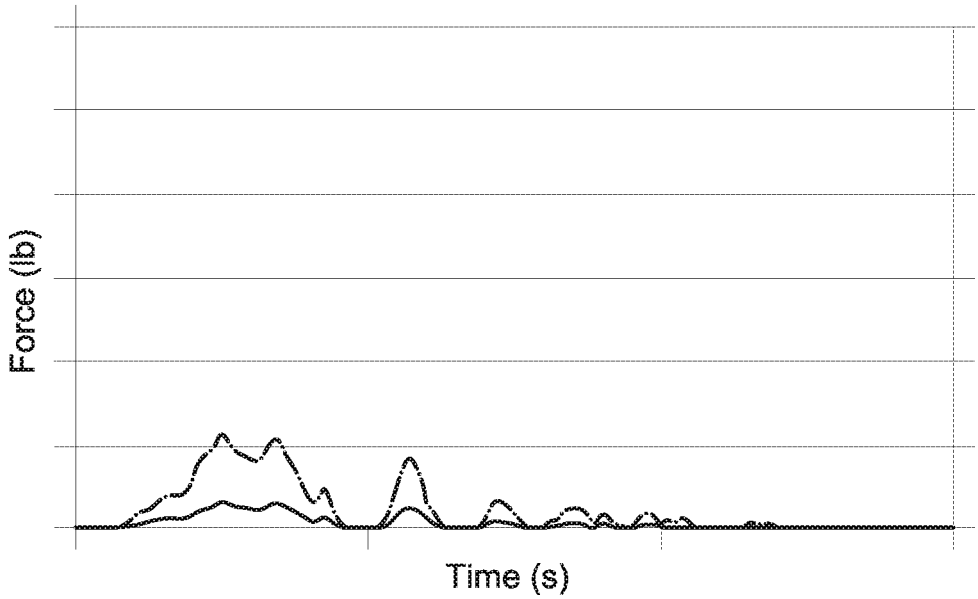

The contact forces at the blade were also analyzed. FIGS. **6*a*-6*b* illustrate the effect of a coating system in accordance with one embodiment of the present invention on the contact force on a compressor blade in one compressor stage. FIGS. 7*a*-7*b*** illustrate the effect of a coating system in accordance with one embodiment of the present invention on the contact force on a compressor blade in one compressor stage. The dotted lines in the figures represent the radial force and the solid black lines represent the tangential force. While certain aft stages were analyzed, the present coating system is not limited to such stages and can be applied to any stage of the compressor. The analysis was performed with a baseline blade ("Baseline") and a blade coated with softer material ("Coated Blade") with the same boundary conditions. The coated blade experienced lower contact forces and lower amplitudes of radial displacement (particularly in the leading edge) within the rub region. The reduction in contact forces and amplitudes of radial displacement contributes towards the overall reduction in wear to incursion ratio.

While the invention has been described in terms of one or more particular embodiments, it is apparent that other forms could be adopted by one skilled in the art. It is to be understood that the use of "comprising" in conjunction with the coating compositions described herein specifically discloses and includes the embodiments wherein the coating compositions "consist essentially of" the named components (i.e., contain the named components and no other components that significantly adversely affect the basic and novel features disclosed), and embodiments wherein the coating compositions "consist of" the named components (i.e., contain only the named components except for contaminants which are naturally and inevitably present in each of the named components).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A coated compressor blade, the coated compressor blade comprising:

a compressor blade having a blade tip with a blade tip surface, wherein the compressor blade comprises a base material, wherein the blade tip surface has a leading edge, a mid-chord, and a trailing edge; and a coating system comprising an abradable material disposed along the blade tip surface, wherein the coating system has a larger thickness along the leading edge than the coating system, if present, along the trailing edge.

2. The coated compressor blade according to claim 1, wherein the abradable material comprises zirconia stabilized with calcia, magnesia, yttria, ceria, rare earth oxides, or combinations thereof; rare earth di- or mono-silicates; alumina-silicates; alumina; or combinations thereof.

3. The coated compressor blade according to claim 1, wherein the blade tip surface has a leading edge, a mid-chord, and a trailing edge and the coating system is disposed along the leading edge and not disposed along the trailing edge.

4. The coated compressor blade according to claim 1, wherein the compressor blade is configured to be positioned in a compressor case and the coating system has a hardness about 20% to about 90% lower than a base material of the compressor case.

5. The coated compressor blade according to claim 1, wherein the compressor blade is configured to be positioned in a compressor case and the coating system has a modulus about 20% to about 90% lower than a base material of the compressor case.

6. The coated compressor blade according to claim 1, wherein the coating system has a thickness of about 102 microns to about 254 microns.

7. The coated compressor blade according to claim 1, wherein the coating system does not include a bond coat.

8. The coated compressor blade according to claim 1, wherein the blade has a curved body.

9. The coated compressor blade according to claim 1, wherein the blade is configured to be positioned in a turbofan engine.

10. A gas turbine engine comprising:

a compressor comprising a compressor case having an inner surface, wherein the compressor case comprises a base material, and a compressor blade having a blade tip, wherein the compressor blade comprises a base material, wherein the blade tip defines a blade tip surface having a leading edge, a mid-chord, and a trailing edge; and a coating system disposed along the blade tip of the compressor blade, wherein the coating system has a hardness less than a hardness of the compressor case base material, wherein the coating system has a larger thickness along the leading edge than the coating system, if present, along the trailing edge.

11. The system according to claim 10, wherein the coating system does not include a bond coat.

12. The system according to claim 10, wherein the coating system comprises an abradable material.

13. The system according to claim 10, wherein the hardness of the coating system is about 20% to about 90% lower than the hardness of the compressor case base material.

14. A method of preparing a coated compressor blade, the method comprising:

forming a coating system comprising an abradable material along a surface of a blade tip of a compressor blade, wherein the blade tip defines a blade tip surface having a leading edge, a mid-chord, and a trailing edge, and wherein the coating system has a larger thickness along the leading edge than the coating system, if present, along the trailing edge.

15. The method according to claim 14, wherein forming the coating system along the surface of the blade tip comprises forming the abradable material along a leading edge of the blade tip to a thickness of about 102 microns to about 254 microns.

16. The method according to claim 14, wherein forming the coating system along the surface of the blade tip comprises forming the abradable material along a leading edge of the blade tip to a thickness of about 127 microns to about 254 microns and not disposing abradable material along a trailing edge of the blade tip.

17. The method according to claim 14, wherein the compressor blade is configured to be positioned in a compressor case and the coating system has a hardness about 20% to about 90% lower than a base material of the compressor case.

18. The method according to claim 14, wherein the compressor blade is configured to be positioned in a compressor case and the coating system has a modulus about 20% to about 90% lower than a base material of the compressor case.

* * * * *